US011800928B2

(12) United States Patent
Gatto et al.

(10) Patent No.: US 11,800,928 B2
(45) Date of Patent: Oct. 31, 2023

(54) PRODUCT DISPLAY UNITS WITH DIVIDERS

(71) Applicant: Marmon Foodservice Technologies, Inc., Osseo, MN (US)

(72) Inventors: Daniel Gatto, Chappaqua, NY (US); Marty Illers, Yonkers, NY (US); John D. Connell, Bay Shore, NY (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 17/715,268

(22) Filed: Apr. 7, 2022

(65) Prior Publication Data

US 2022/0322824 A1 Oct. 13, 2022

Related U.S. Application Data

(60) Provisional application No. 63/238,581, filed on Aug. 30, 2021, provisional application No. 63/171,613, filed on Apr. 7, 2021.

(51) Int. Cl.

| | |
|---|---|
| ***A47B 57/58*** | (2006.01) |
| ***A47B 96/04*** | (2006.01) |
| ***A47F 5/00*** | (2006.01) |

(52) U.S. Cl.

CPC ..... *A47B 57/588* (2013.01); *A47B 96/04* (2013.01); *A47F 5/005* (2013.01)

(58) Field of Classification Search

CPC ..... A47B 57/588; A47B 57/58; A47B 57/583; A47B 65/10; A47B 96/04; A47B 65/15; A47F 5/005; A47F 7/144

(Continued)

(56) References Cited

U.S. PATENT DOCUMENTS

| | | | |
|---|---|---|---|
| 3,298,327 | A | 1/1967 | Grimes |
| D209,800 | S | 1/1968 | Brooks |

(Continued)

FOREIGN PATENT DOCUMENTS

| | | | |
|---|---|---|---|
| CN | 207306473 | U | 5/2018 |
| CN | 208384701 | U | 1/2019 |

(Continued)

OTHER PUBLICATIONS

"Spacemaker", PFI, https://pfinnovation.com/cold-vault-merchandising/spacemaker/, 4 pages, accessed Apr. 5, 2022.

(Continued)

*Primary Examiner* — Jennifer E. Novosad

(74) *Attorney, Agent, or Firm* — ANDRUS INTELLECTUAL PROPERTY LAW, LLP

(57) ABSTRACT

A product display unit is for displaying products and includes base with a body extending between the base ends and the base sides. A base further includes a first rib and a second rib each extending from the body in a first vertical direction and defining a channel defined therein. A slot vertically extends through the body and is vertically aligned with the channel. A pair of projections extend from the body in a second vertical direction opposite the first vertical direction and define a void therebetween. The projections and the void are in vertical alignment with the first rib. A divider having a bottom side and a tab extending in the second vertical direction from the bottom side is coupled to the base. The tab includes transversely extending barb.

13 Claims, 8 Drawing Sheets

(58) Field of Classification Search
USPC ..... 211/184; 108/61, 60
See application file for complete search history.

(56) References Cited

U.S. PATENT DOCUMENTS

| | | | | |
|---|---|---|---|---|
| 3,872,976 | A | 3/1975 | Moore et al. | |
| D238,472 | S | 1/1976 | Moore et al. | |
| D244,735 | S | 6/1977 | Kennedy, Jr. et al. | |
| 4,181,229 | A * | 1/1980 | Moore | A47F 5/005 211/184 |
| 4,488,653 | A | 12/1984 | Belokin | |
| D319,909 | S | 9/1991 | Snediker et al. | |
| D370,595 | S | 6/1996 | Koziol | |
| 5,607,068 | A | 3/1997 | Coretti, Jr. et al. | |
| 5,971,173 | A | 10/1999 | Valiulis et al. | |
| 6,082,557 | A * | 7/2000 | Leahy | A47B 96/021 211/59.3 |
| D611,743 | S | 3/2010 | Mitten et al. | |
| 8,016,139 | B2 * | 9/2011 | Hanners | A47F 5/005 211/184 |
| 8,499,942 | B1 | 8/2013 | Coretti, Jr. et al. | |
| D702,068 | S | 4/2014 | Mitten et al. | |
| 9,060,624 | B2 * | 6/2015 | Hardy | A47F 1/126 |
| 9,220,353 | B2 | 12/2015 | Brugmann | |
| 9,380,889 | B2 | 7/2016 | Howard | |
| D766,023 | S | 9/2016 | Coretti, Jr. et al. | |
| 9,549,622 | B2 * | 1/2017 | Leahy | A47F 5/005 |
| 9,591,923 | B2 * | 3/2017 | Zeidner | A47B 57/588 |
| D799,252 | S | 10/2017 | Coretti, Jr. et al. | |
| 9,986,854 | B2 * | 6/2018 | Riley | A47F 1/126 |
| D827,429 | S | 9/2018 | Sanfilippo et al. | |
| 10,064,500 | B2 | 9/2018 | Furui et al. | |
| 10,098,478 | B2 * | 10/2018 | Miller, Jr. | A47F 1/12 |
| D833,781 | S | 11/2018 | Hartman et al. | |
| 10,349,756 | B2 | 7/2019 | Riley et al. | |
| 10,448,756 | B2 * | 10/2019 | Hardy | A47B 57/583 |
| 10,548,414 | B2 * | 2/2020 | Kologe | A47F 7/285 |
| 10,561,241 | B2 | 2/2020 | Albarran et al. | |
| 10,617,206 | B2 | 4/2020 | Brugmann | |
| 10,702,075 | B2 | 7/2020 | Hardy | |
| 10,765,233 | B2 * | 9/2020 | Cassidy | A47F 5/005 |
| D905,482 | S | 12/2020 | Coretti, Jr. et al. | |
| D908,410 | S | 1/2021 | Illers | |
| D929,163 | S * | 8/2021 | Au | D6/706 |
| 2002/0179553 | A1 * | 12/2002 | Squitieri | A47F 5/005 211/74 |
| 2002/0179556 | A1 | 12/2002 | Osawa | |
| 2003/0010737 | A1 * | 1/2003 | Lee | A47F 3/147 211/175 |
| 2003/0132178 | A1 * | 7/2003 | Jay | A47B 96/021 211/175 |
| 2004/0178156 | A1 | 9/2004 | Knorring, Jr. et al. | |
| 2005/0150847 | A1 | 7/2005 | Hawkinson | |
| 2006/0237384 | A1 * | 10/2006 | Neumann | A47F 1/12 211/184 |
| 2007/0175844 | A1 | 8/2007 | Schneider | |
| 2009/0277924 | A1 | 11/2009 | Kottke et al. | |
| 2010/0252519 | A1 | 10/2010 | Hanners et al. | |
| 2013/0020270 | A1 | 1/2013 | Valiulis et al. | |
| 2013/0078035 | A1 * | 3/2013 | Mueller | A47F 5/005 403/345 |
| 2013/0248475 | A1 * | 9/2013 | Erickson | A47F 5/005 211/119.003 |
| 2014/0339181 | A1 | 11/2014 | Hardy | |
| 2015/0359358 | A1 | 12/2015 | Miller, Jr. et al. | |
| 2015/0374120 | A1 | 12/2015 | Hardy | |
| 2016/0000235 | A1 | 1/2016 | Hardy et al. | |
| 2016/0242573 | A1 * | 8/2016 | Colelman | A47B 57/588 |
| 2016/0278540 | A1 | 9/2016 | Gommermann et al. | |
| 2016/0316936 | A1 | 11/2016 | Camello et al. | |
| 2017/0007040 | A1 | 1/2017 | Howard et al. | |
| 2017/0035218 | A1 | 2/2017 | Riley et al. | |
| 2018/0078054 | A1 | 3/2018 | Miller, Jr. et al. | |
| 2019/0104863 | A1 * | 4/2019 | Illers | A47F 1/125 |
| 2019/0183243 | A1 * | 6/2019 | Brügmann | A47B 57/588 |
| 2022/0322824 | A1 * | 10/2022 | Gatto | A47B 96/04 |

FOREIGN PATENT DOCUMENTS

| | | | |
|---|---|---|---|
| CN | 208988298 | U | 6/2019 |
| CN | 107411436 | A | 7/2020 |
| CN | 211883132 | U | 11/2020 |
| CN | 211883165 | U | 11/2020 |

OTHER PUBLICATIONS

"Modular Glide", PFI, https://pfinnovation.com/cold-vault-merchandising/modular-glide/, 4 pages, accessed Apr. 5, 2022.
"Intelli-Glide", PFI, https://pfinnovation.com/cold-vault-merchandising/intelli-raller-26-36-units/, 6 pages, accessed Apr. 5, 2022.
"Cool Guide", PFI, https://pfinnovation.com/cold-vault-merchandising/cool-glide/, 5 pages, accessed Apr. 5, 2022.
"Cool Guide 20/20", PFI, https://pfinnovation.com/cool-glide-2020/, 13 pages, accessed Apr. 5, 2022.
U.S. Appl. No. 29/805,798, filed Aug. 30, 2021, "Divider".
PCT/US2022/023780, International Search Report and Written Opinion, dated Jun. 30, 2022.

* cited by examiner

PRODUCT DISPLAY UNITS WITH DIVIDERS

CROSS REFERENCE TO RELATED APPLICATIONS

The present disclosure is based on and claims priority to U.S. Provisional Patent Application Nos. 63/171,613 filed Apr. 7, 2021, and 62/238,581 filed Aug. 30, 2021, the disclosures of which are incorporated herein by reference.

FIELD

The present relates to product display units for displaying and dispensing products, and specifically to product display units with dividers.

BACKGROUND

The following U.S. patents are incorporated herein by reference in entirety.

U.S. Pat. No. 9,380,889 discloses a guide assembly for displaying a plurality of products. The guide assembly includes a base, a first lateral wall, and a second lateral wall. Each lateral wall includes a plurality of support members and a rail. The support members extend upwardly from a lateral side of the base.

U.S. Pat. No. 9,986,854 discloses a product display assembly that includes a floor and a divider. The divider selectively engages the floor and extends in a longitudinal direction.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a product display unit is for displaying products and includes a base longitudinally extending between a first base end and an opposite second base end and transversely extending between a first base side and an opposite second base side. The base includes a body extending between the base ends and the base sides, and a first rib and a second rib each extending from the body in a first vertical direction and defining a channel defined therein. A slot vertically extends through the body and is vertically aligned with the channel. A pair of projections extend from the body in a second vertical direction opposite the first vertical direction and define a void therebetween. The projections and the void are in vertical alignment with the first rib. A divider having a bottom side and a tab extending in the second vertical direction from the bottom side is coupled to the base. The tab includes a transversely extending barb. The divider is coupled to the base by moving the divider in the second vertical direction such that the tab is received into the slot and the barb is received into the void. The barb prevents inadvertent movement of the tab in the first vertical direction out of the slot.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Product display units are for use in retail stores for dispensing products to customers, and the products, such as soda bottles, milk jugs, and juice cans, are positioned on the display units. As customers remove products from the front of the display unit, the remaining products are moved, by gravity or a pusher, toward the front of the display unit.

The present inventors developed the new display units described hereinbelow. Note that several example display units are described hereinbelow and the features and components described with reference to each example display unit can be utilized and combined with any of the other example display units described hereinbelow or example display units described in the above-incorporated patents and patent applications.

Figure 1:
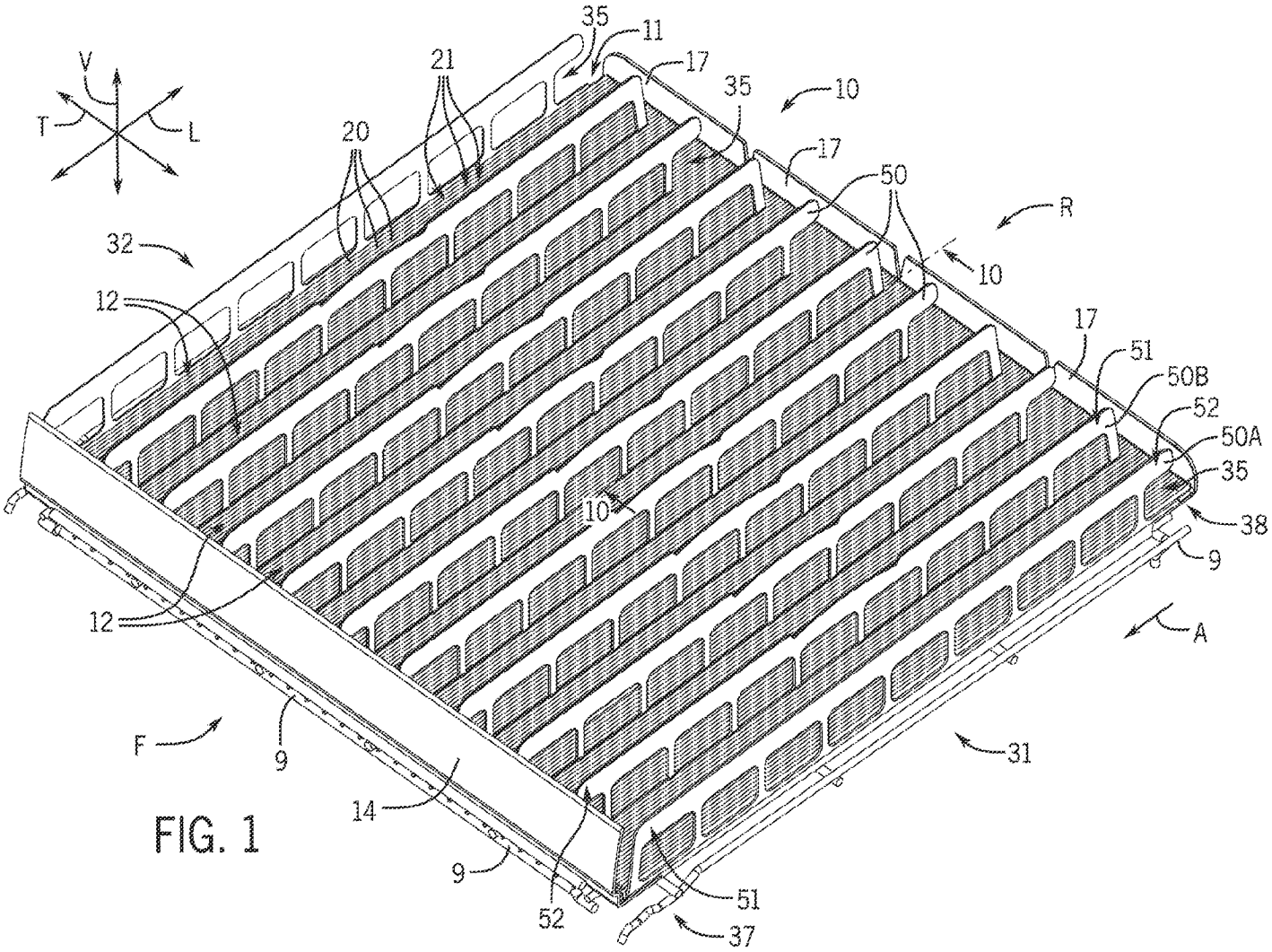
FIG. 1 is a perspective view of an example product display unit of the present disclosure.
Figure 2:
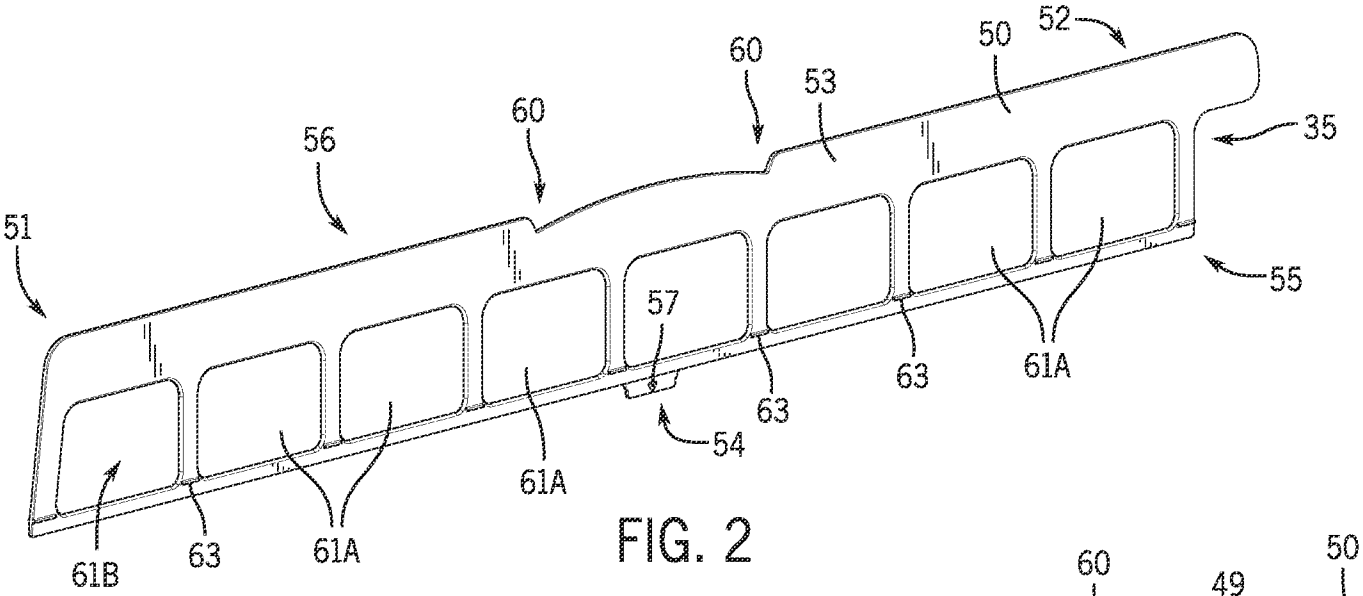
FIG. 2 is a top perspective view of an example divider according to the present disclosure.
Figure 3:
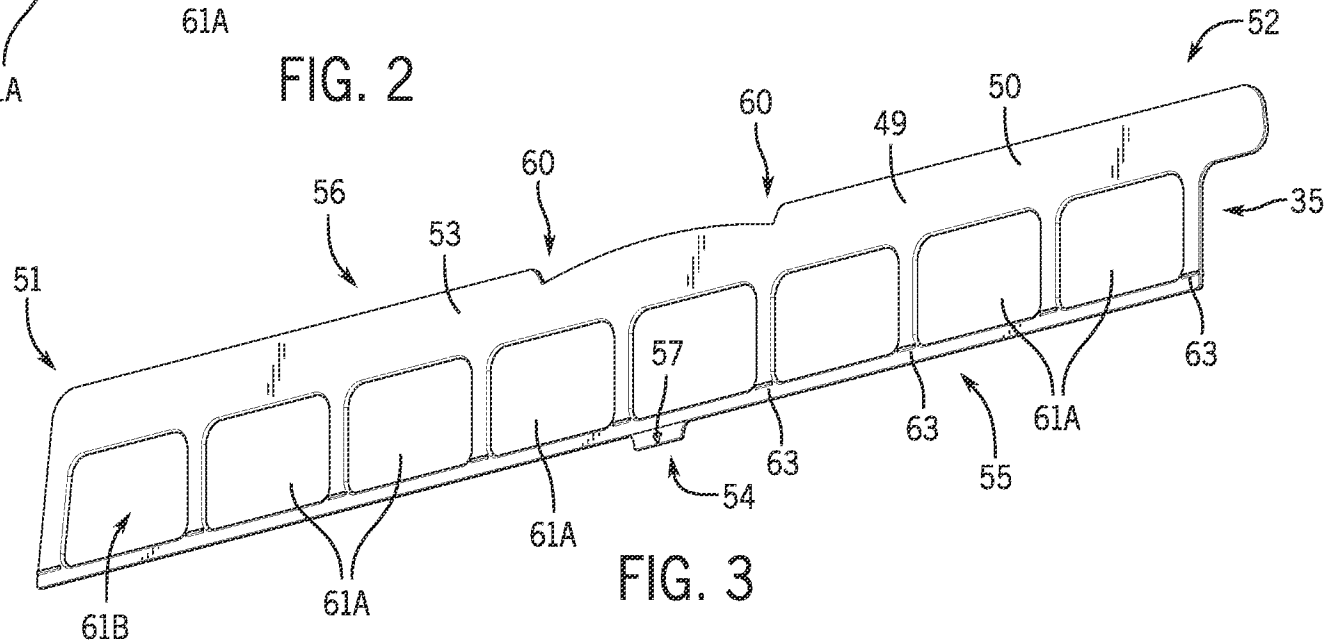
FIG. 3 is a bottom perspective view of the divider of FIG. 2.
Figure 4:
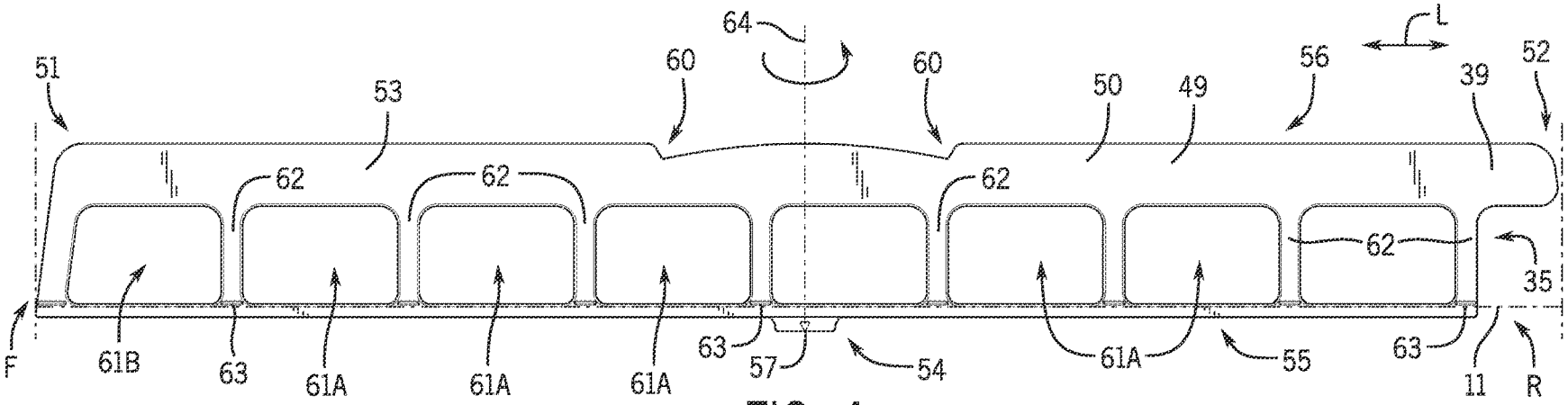
FIG. 4 is a first side elevation view of the divider of FIG. 2.
Figure 5:
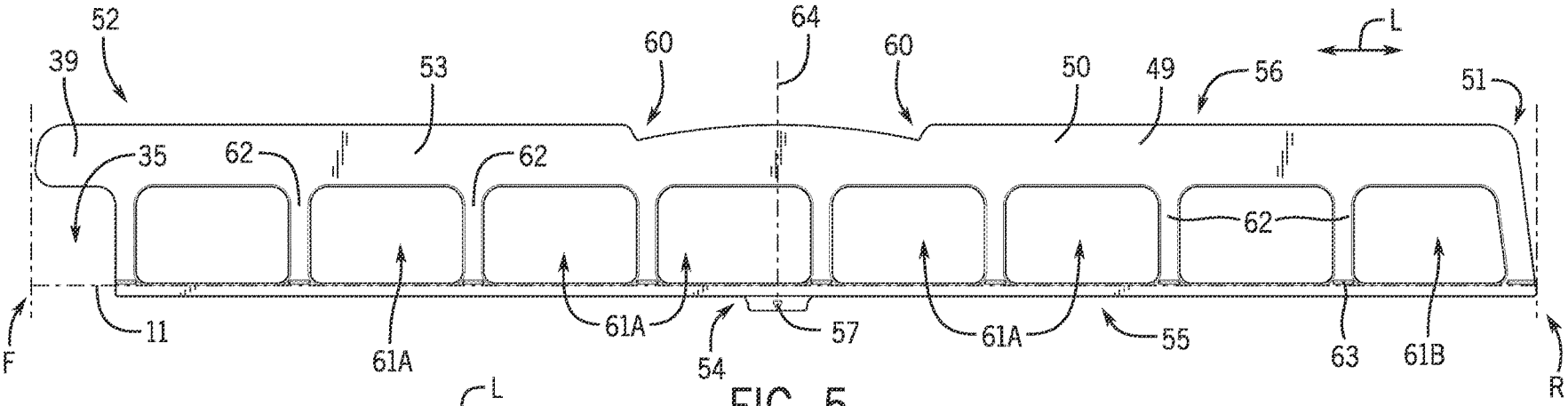
FIG. 5 is a second side elevation view of the divider of FIG. 2.
Figure 7:
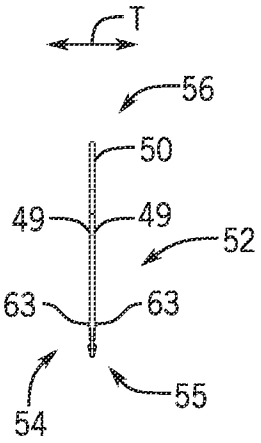
FIG. 7 is a second end elevation view of the divider of FIG. 2.
Figure 6:
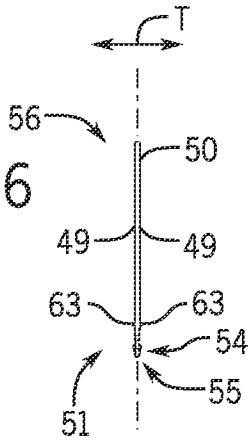
FIG. 6 is a first end elevation view of the divider of FIG. 2.
Figure 8:
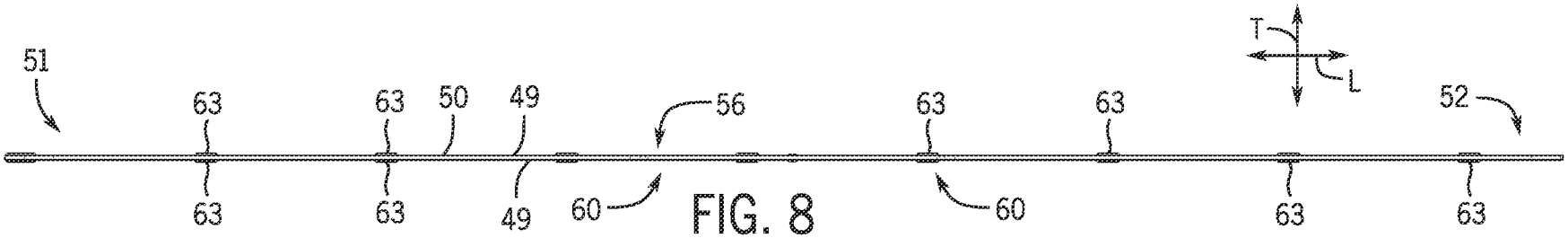
FIG. 8 is a top plan view of the divider of FIG. 2.
Figure 9:
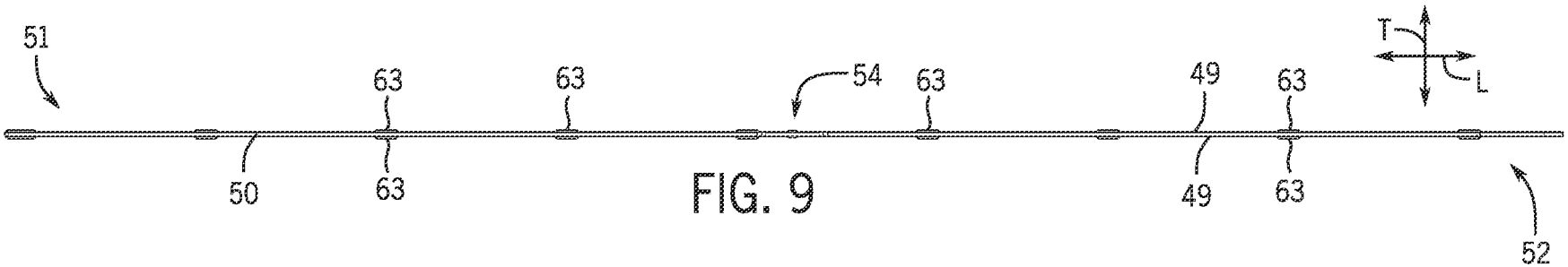
FIG. 9 is a bottom plan view of the divider of FIG. 2.

FIG. 1 depicts an example product display unit 10. The display unit 10 generally longitudinally extends (see arrow L) between a first end (front) F and a second end (rear) R and transversely extends (see arrow T) between opposing sides, namely a first side 31 and a second side 32. Note that certain components of the display unit 10 may also vertically extend (see arrow V).

The display unit 10 includes a base 11 on which products (not depicted) are supported and a plurality of dividers 50 (described further herein) that define tracks 12 that longitudinally extend along the base 11. The products are placed into the tracks 12 (e.g., one row of multiple bottles is contained in each track 12), and the products are urged toward the front F of the display unit 10 by gravity or a pusher (not depicted). The base 11 rests on a shelf 9 that can be sloped or angled in a direction from the rear R to the front F of the display unit 10 such that products P on the base 11 tend to move by force of gravity toward the front F of the display unit 10 (see arrow A). In this example, after a customer removes a product from the display unit 10, the other products in the same track 12 tend to move toward the front F of the display unit 10 such that another customer can select and/or remove additional products.

FIGS. 2-9 depict an example divider 50 according to the present disclosure. The divider 50 includes a first divider end 51 and an opposite second divider end 52. The divider 50 is generally planar (see dashed line on FIG. 6 that generally depicts the plane in which the divider 50 generally lies). When coupled to the base 11, the divider 50 longitudinally extends parallel to the ribs 20 between the front F and the rear R of the display unit 10 (see FIG. 1 which depicts eleven dividers 50 coupled to the base 11). The divider 50 also vertically extends away from the base 11 to thereby define the tracks 12 (FIG. 1) and thereby prevent products from inadvertently moving into adjacent tracks 12. The divider 50 is formed from any suitable material such as plastic, metal, and/or wood. In certain examples, the divider 50 is formed of rigid materials to thereby prevent transverse deformation.

One or more dividers 50 are utilized with the display unit 10 to define the tracks 12 and the dividers 50 are removably coupled to the base 11 (described further herein). Each divider 50 extends between the front F and the rear R of the display unit 10 (see FIG. 1). In operation, a technician can easily couple the divider(s) 50 to different locations or positions on the base 11, and accordingly, the technician can define one or more tracks 12 having appropriate width to thereby accommodate the products placed on the base 11. In one example, the dividers 50 are coupled to the base 11 such that small diameter aluminum soda cans can be positioned within each track 12. Subsequently, if the technician instead wishes to display large diameter beverage bottles (e.g., twenty-ounce soda bottles, large bottles of athletic drinks), the technician simply decouples one or more dividers 50 from the base 11 and recouples the divider(s) 50 to the base 11 in different positions such that the track 12 can receive and accommodate the large diameter beverage bottles. In this way, the technician can vary the distance between adjacent dividers 50 and thereby vary width of the tracks 12.

The divider 50 includes opposing faces 49, a bottom side 55, and an opposite top side 56. The bottom side 55 is tapered in a direction from the top side 56 to the bottom side 55, and the shape of the bottom side 55 corresponds to the shape of a channel 21 defined between two adjacent ribs 20 (described further hereinbelow, see FIGS. 10 and 13) such that the bottom side 55 can be inserted into and nested in one of the channels 21 (see FIG. 10). As such, the bottom side 55 of the divider is transversely supported by the adjacent ribs 20 (e.g., the adjacent ribs 20 prevent transverse movement of the divider 20). In certain examples, the adjacent ribs 20 are along the longitudinally length of the bottom side 55 such that the ribs 20 transversely support the divider 20 along its longitudinal length. Two notches 60 are defined in the middle of the top side 56 to thereby draw the attention of the technician and define a handle grip of the divider 50. The handle grip may also include one or more cutouts 61A, 61B noted below through which the fingers of the technician may extend.

Figure 13:
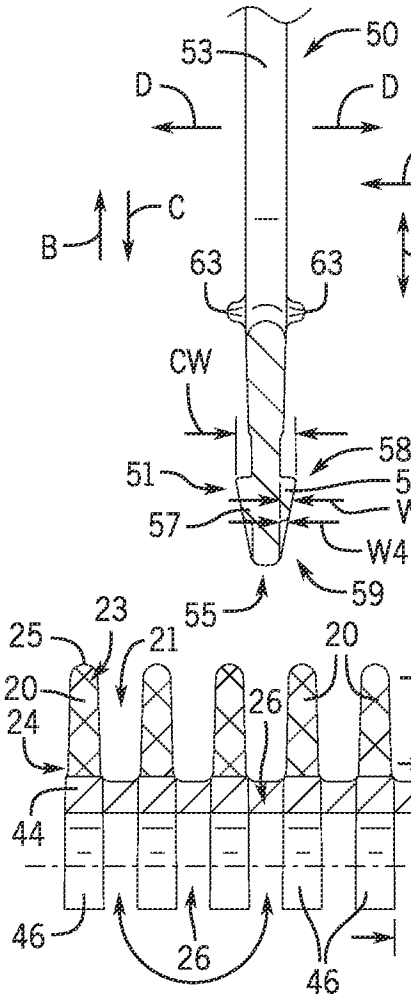
FIG. 13 is a cross-sectional view along line 13-13 on FIG. 12.

A tab 54 extends away from the bottom side 55 of the divider 50, and the tab 54 has opposing barbs 57 that transversely extend away from the tab 54 (see FIG. 13 arrows D). Each barb 57 is tapered such that a first barb end 58 has a width W3 and a second barb end 59 has a width W4 that is less than width W3 (FIG. 13). In certain examples, each barb 57 is a tapered triangular cone. In other examples, each barb 57 is a rectangular prism. Note that the divider 50 also includes a plurality of lips 63 on the wall 53 that extend in the same transverse directions as the barbs 57 (see arrows D on FIG. 13 depicting the first transverse direction and the opposite second transverse direction). The lips 63 are on each side face 49 of the divider 50, and the lips 63 are spaced apart from each other at various locations between the end 51, 52 (see FIGS. 4-5), and the lips 63 seat on and contact a rib surface 25 (see FIG. 15) of the rib 20 when the divider 50 is coupled to the base 11. The lips 63 advantageously prevent wobbling or deformation of the dividers 50 while coupled to the base 11. Note that in other examples, the lips 63 continuously extend along one or both faces 49 of the divider 50 between the ends 51, 52.

In the example depicted in FIGS. 2-9, the divider 50 includes one tab 54 extending from the bottom side 55 of the divider 50. This single tab arrangement is advantageous in certain applications as the technician need only align and insert one tab 54 into one slot 26 (described below) of the base 11. Accordingly, the single tab arrangement can reduce or eliminate misalignment of the divider 50 between adjacent ribs 20. Note that in other examples the divider 50 can include multiple tabs 54 that extend from the bottom side 55 such that the tabs 54 are each received into multiple slots 26 of the base 11.

The divider 50 also includes a wall 53 with one or more cutouts 61A, 61B defined therein. As such, legs 62 of the wall 53 are between the cutouts 61A, 61B. The shape of the cutouts 61A, 61B can vary, and in one example, the first cutouts 61A each have a width that is less than the width of the second cutouts 61B. The second cutout 61B is positioned adjacent to the first divider end 51. The cutouts 61A, 61B allow portions of the products (e.g., the lower enlarged sections of the products) to extend into the cutouts 61A, 61B thereby providing more space in which the products can move while on the base 11. The second divider end 52 includes an opening 35 such that the second divider end 52 longitudinally projecting section 39.

As noted above, multiple identical dividers 50 are used to define the tracks 12 (see FIG. 1), and the dividers 50 are oriented in an alternating pattern relative to each other transversely along the base 11. For example, a first divider 50A (see FIG. 1) is oriented on the base 11 such that the first divider end 51 is positioned near the front F of the product display unit 10 and an adjacent second divider 50B is oriented on the base 11 such that its first divider end 51 is positioned near the rear R of the product display unit 10. As such, the dividers 50A, 50B are in an alternating pattern. The technician can easily couple multiple identical dividers 50 to the base 11 in the alternating pattern noted above.

Coupling the dividers 50 in the alternating pattern to the base 11 (see FIG. 1) advantageously causes the legs 62 of adjacent dividers 50 to be longitudinally offset from each other (e.g., the legs 62 of a second divider 50B do not align with the legs 62 of a first divider 50A). This alternating or offset spacing of the legs 62 permits portions of the products to transversely move (see arrow T on FIG. 1) into the plane of the dividers 50 as the products longitudinally move toward the front F of the display unit 10. Reference is made to the above-noted U.S. Pat. No. 9,380,889 for another example display unit on which products move as noted above. Permitting the products to transversely move while in the tracks 12 allows the products to easily move toward the front F of the display unit 10 and further helps prevent the products from "jamming" in the tracks 12. Further note that the dividers 50 are reversible into different orientations allowing the technician to arrange several identical dividers 50 on the base 11 without needing a quantity of dividers that are dis-similar to a first set of identical dividers 50 (e.g., the technician does not need a second type or shape of divider).

Each divider 50 can be coupled to the base 11 in two different orientations. In a first orientation (see FIG. 4), the first divider end 51 is adjacent to the front F of the product display unit 10 and the first base end 37. Furthermore, the second divider end 52 is adjacent to the rear R of the product display unit 10 and the second base end 38. Note that the front F and the rear R of the product display unit 10 and the base 11 are schematically depicted as dashed lines on FIGS. 4-5 for clarity. In the first orientation, the legs 62 are in first positions relative to the base 11 (FIG. 1). The technician can move the divider 50 into a second orientation (see FIG. 5) in which the first divider end 51 is adjacent to the rear R of the product display unit 10 and the second base end 38 is adjacent to the front F of the product display unit 10 and the first base end 37. Furthermore, the second divider end 52 is adjacent to the front F of the product display unit 10 and the first base end 37. To move the divider 50 into the second orientation (FIG. 5), the technician simply decouples the divider 50 from the base 11 (FIG. 1), rotates the divider 50 180.0 degrees about a center vertical axis 64, and then recouples the divider 50 to the base 11 by reinserting the tab 54 into the same slot 26 in which the tab 54 was received when the divider 50 is in the first orientation. In the second orientation (FIG. 5), the legs 62 are in second positions relative to the base 11 (FIG. 1). The legs 62 in the second positions are offset longitudinally from the legs 62 in the first positions (compare the first positions of the legs 62 in FIG. 4 to the second positions of the legs 62 in FIG. 5).

Figure 12:
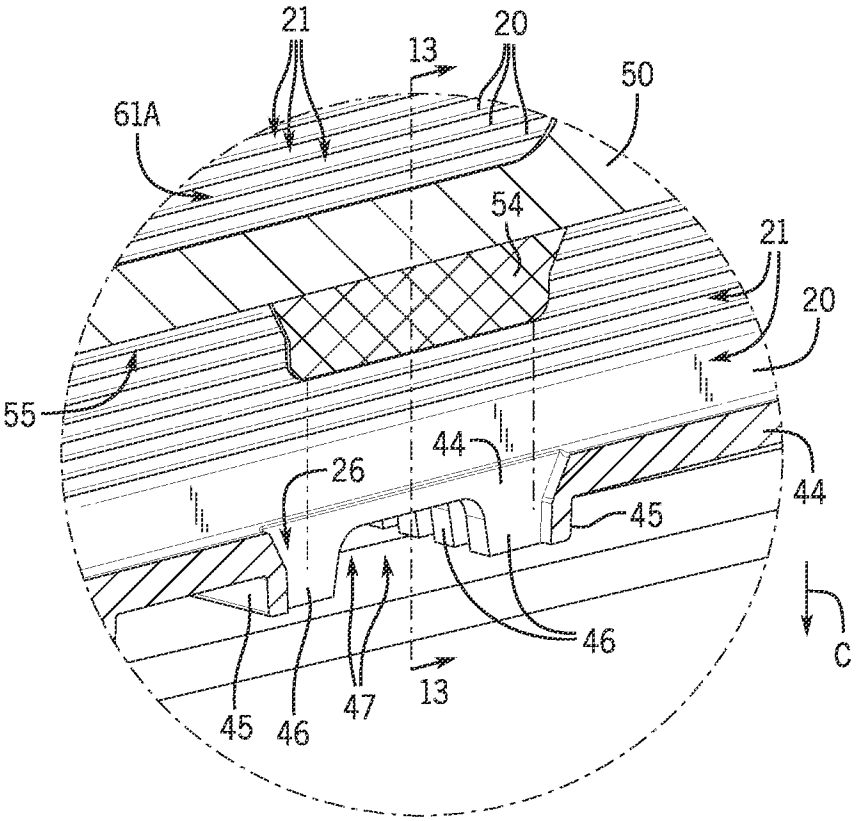
FIG. 12 is an enlarged view within line 11-11 on FIG. 10 with the tab of the divider in vertical alignment with the slot of the base.
Figure 11:
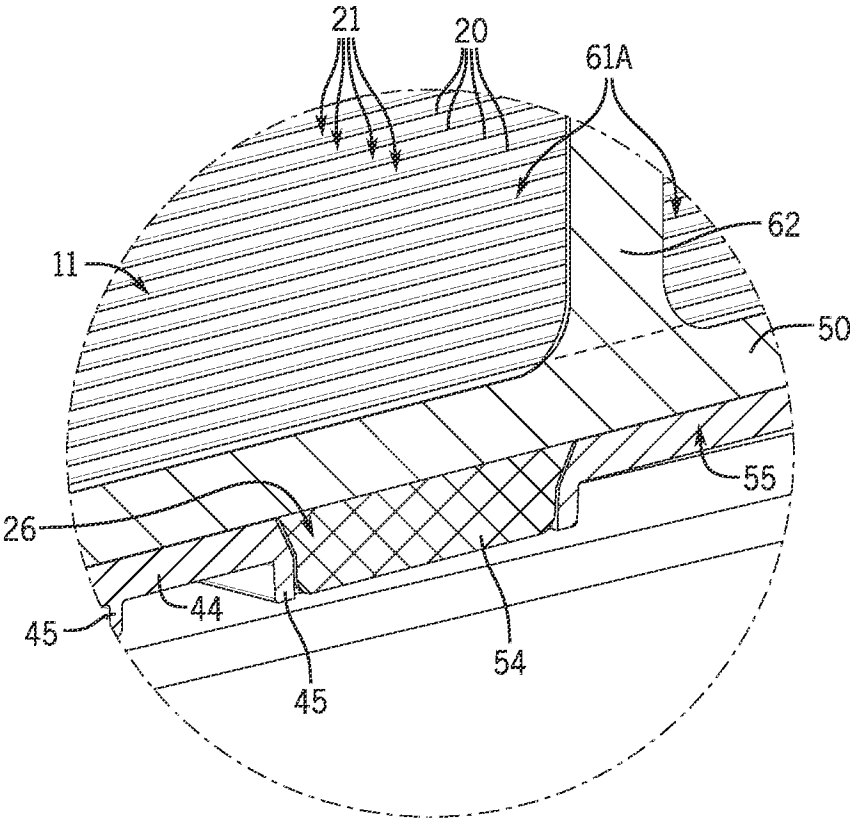
FIG. 11 is an enlarged view within line 11-11 on FIG. 10 with a tab of the divider received into a slot of a base.

Turning back to FIG. 1, the base 11 includes a plurality of parallel fins or ribs 20 that each longitudinally extend between a first base end 37 near the front F of the display unit 10 and a second base end 38 near the rear R of the display unit 10. The ribs 20 also extend in a first vertical direction (see arrow B on FIG. 13) away from a body 44 (FIG. 13) of the base 11. The ribs 20 are transversely spaced apart from each other. Note that the base 11 transversely extends between a first base side (which corresponds to the first side 31 of the product display unit 10) and an opposite second base side (which corresponds to the second side 32 of the product display unit 10). The ribs 20 are coupled to the body 44 (FIG. 10) and vertically extend away from the body 44 in the first vertical direction (see arrow B on FIG. 13). The body 44 is generally planar with the ribs 20 extending in the first vertical direction (arrow B) from the top side of the body 44 and projections 46 (described further herein) extending in a second vertical direction (arrow C) from the opposite bottom side of the body 44 (see also FIG. 13). Two projections 46 are planar with and vertically aligned with each rib 20 (see FIG. 12). The ribs 20 are spaced apart from each other such that a channel 21 (described further herein) is defined between each rib 20. The channels 21 extend parallel to each other and the ribs 20. As such, one or more dividers 50 can be received into the channels 21 to thereby define the tracks 12 on the base 11 as described above. Note that in one example the body 44 is flat planar panel and in one instance the body 44 as a flat rectangular panel.

The base 11 includes one or more front panels 14 along the front F of the product display unit 10, and the front panel 14 prevents products from inadvertently moving off the base 11 over the front F of the product display unit 10. The front panel 14 can be integrally formed with other components of the base 11 or be selectively removable from components of the base 11. Similarly, the base 11 includes one or more rear panels 17 along the rear R of the product display unit 10. The rear panel 17 prevents products from inadvertently moving off the base 11 over the rear R of the product display unit 10. The rear panel 17 can also be integrally formed with other components of the base 11 or be selectively removable from the base 11. The ribs 20 may terminate at the front panel 14 and/or the rear panel 17, and in certain examples, the panels 14, 17 can includes panel ribs 30 (see FIG. 10 with example panel ribs 30 depicted in dashed lines on the rear panel 17 as exemplary) that extend along the surface of the panels 14, 17 and align with corresponding ribs 20. In these examples, the divider 50 is also received between adjacent panel ribs 30 and the panel ribs 30 prevent transverse movement of the dividers 50.

Figure 10:
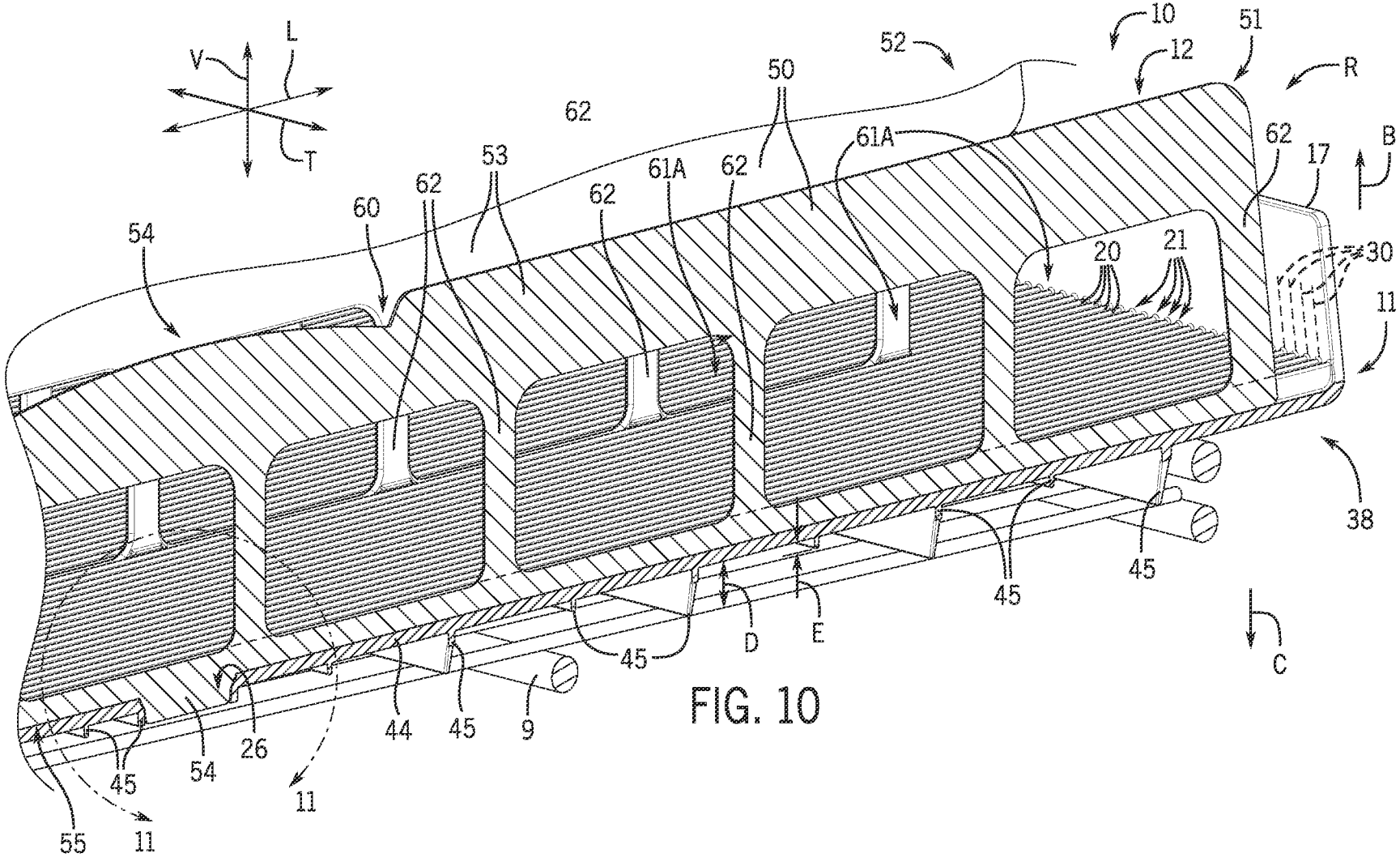
FIG. 10 is a partial cross-sectional view of the product display unit and one of the dividers along line 10-10 on FIG. 1.

Referring now specifically to FIG. 10, the base 11 is depicted in greater detail. A plurality of support members 45 are coupled to the body 44 opposite the ribs 20 and extend in a second vertical direction (see arrow C on FIG. 10) therefrom. The support members 45 increase the rigidity of the base 11, and the support members 45 contact the underlying shelf 9. The support members 45 can be arranged in any pattern such as linear rows that are generally perpendicular to ribs 20 or in a honeycomb pattern. The size of the support members 45 can also vary, and in the example base 11 depicted in FIG. 10, certain support members 45 have a first depth (see depth D) and other support members 45 have a second depth (see depth E). Note that the ribs 20 are integrally formed with the body 44 including the support members 45. In certain examples, the ribs 20 and the body 44 collectively form a panel-like structure.

Turning additionally to FIG. 13, the ribs 20, the channels 21, and the body 44 are further depicted. Each rib 20 (depicted in cross-hatching on FIG. 13) has a first rib end 23 and an opposite second rib end 24. The first rib end 23 is vertically spaced apart from the second rib end 24, and the second rib end 24 is coupled to the body 44. The rib 20 tapers in a direction from the second rib end 24 to the first rib end 23 such that the width W1 of the rib 20 at the second rib end 24 is greater than the width W2 of the rib at the first rib end 23. The first rib ends 23 have a rib surface 25 on which the products rest. The shape of the rib surface 25 can vary, and in the example depicted in FIG. 13, the rib surface 25 is curved to thereby minimize friction generated between the products and the rib surface 25. The rib surface 25 of each rib 20 collectively define a support surface of the display unit 10.

Note that in certain examples at least a portion of each rib surface 25 lies in a common plane, and in certain examples, the shape of the channel 21 corresponds to the shape of the rib 20. In the example depicted in FIG. 13, the channel 21 tapers in a direction from the rib surface 25 toward the body 44.

The body 44 has a plurality of slots 26 such that a tab 54 of a divider 50 (see FIGS. 13-15) can be removably received into one of the slots 26 when the divider 50 is coupled to the base 11. Each slot 26 is aligned with one of the channels 21 such that the slot 26 is in communication with the channel 21. The slots 26 are aligned with each other along a transversely extending axis 27 (see FIGS. 13 and 16) that extends parallel to the base ends 37, 38. Each slot 26 has a slot width SW (FIG. 13) that is less than the collective width of the tab 54 and the barb(s) 57 (see CW on FIG. 13).

Projections 46 (see FIGS. 12 and 16) extend in the second vertical direction (see arrow C on FIG. 12) from the body 44 and further define the slots 26. The projections 46 are planar with the ribs 20 and in vertical alignment with the ribs 20

(see FIG. 13). The projections 46 define voids 47 therebetween that are also planar with the ribs 20 and below the body 44 (see FIG. 12) in which the barbs 57 of the dividers 50 are received. The voids 47 are transversely offset from the slots 26. FIG. 13 depicts a general outline of one of the slots 26 in dashed lines and the general outlines of adjacent voids 47 in dash-dot lines. In this example, the slot 26 vertically extends from a first horizontal plane that aligns with the top side of the body 44 to a second horizontal plane that aligns with the bottom side of the projections 46. The slot 26 is also partially bound and defined by the vertical surfaces of the projections 46 (see also FIG. 12). Each void 47 is partially defined by two projections 46 that are planar with and in vertical alignment with one of ribs 20 (see FIG. 12). In one instance, one set of two projections 46 partially defines one of the voids 47 and another transversely offset set of two projections 47 that are planar and vertically aligned with another rib 20 define another void 47 (see also FIG. 16). When the divider 50 is coupled to base 11 (see FIG. 15), the wall 53 is transversely supported by the adjacent ribs 20, the tab 54 is transversely supported by the projections 46, and the barbs 57 are received into the voids 47. The barbs 57 prevent the tab 54 from inadvertently moving out of the slot 26.

Figure 14:
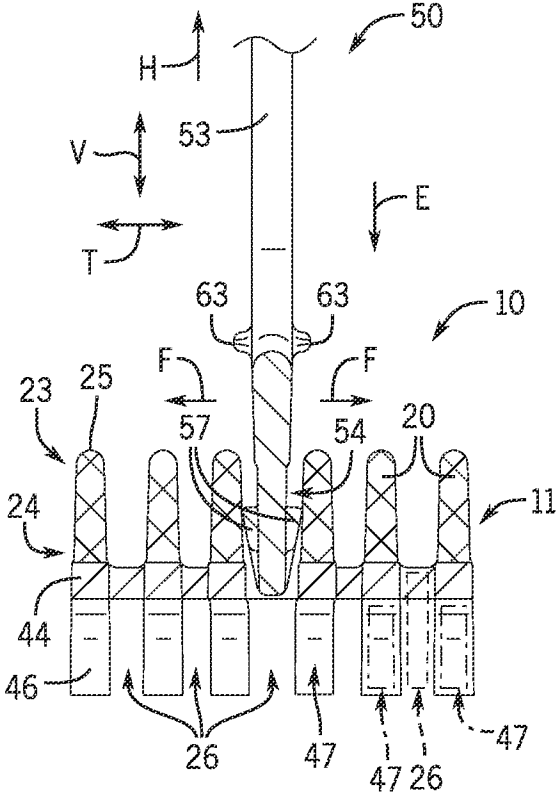
FIG. 14 is a view like FIG. 13 with the divider being inserted between two ribs and a tab of the divider being inserted into a slot of the base.
Figure 15:
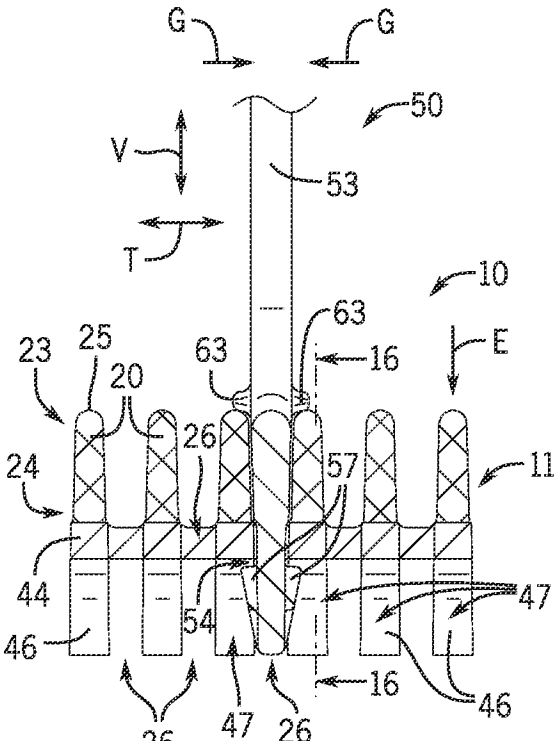
FIG. 15 is a view of like FIG. 13 with the divider inserted between two ribs and the tab of the divider inserted into the slot.
Figure 16:
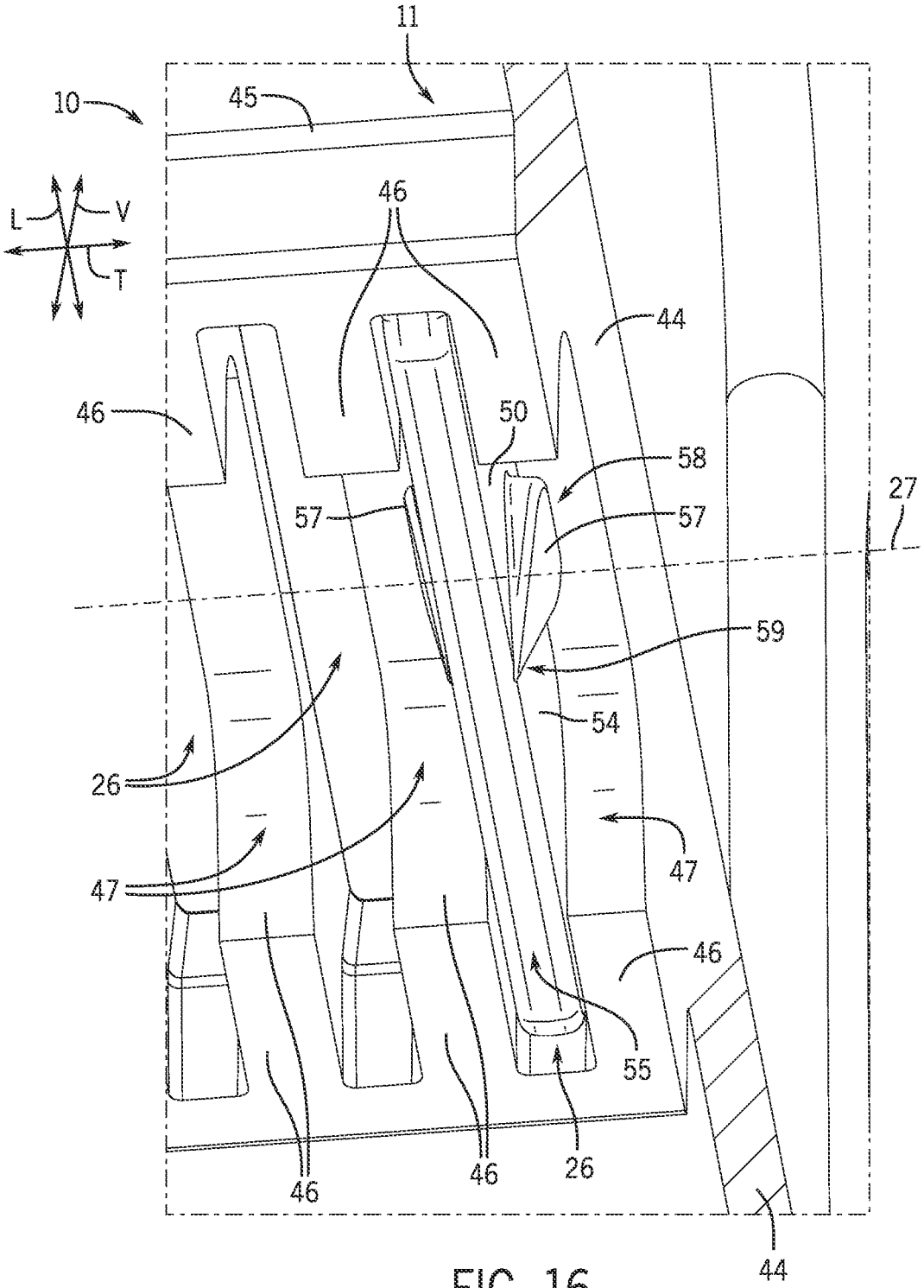
FIG. 16 is a perspective view that depicts the bottom of the base when the tab is received into the slot in the approximate location denoted by line 16-16 on FIG. 15.

Referring specifically to FIG. 13-16, an example operational sequence for coupling a divider 50 to the base 11 is depicted. As noted above, the technician may seek to define a track 12 on the base 11 and/or adjust the width of one or more tracks 12 (FIG. 1). Referring to FIG. 13, the technician begins by moving the divider 50 into vertical alignment with one of the channels 21 such that the tab 54 is also vertically aligned with the corresponding slot 26. The technician then vertically moves (see arrow E) the divider 50 toward and into the channel 21, as depicted in FIG. 14. As the tab 54 is moved into and/or through the channel 21, the barbs 57 apply transversely directed forces to the immediately adjacent ribs 20 which cause the ribs 20 to transversely deflect (see arrows F). As depicted in FIG. 15, the technician continues to vertically move the divider 50 into the channel 21 (see arrow E) such that the tab 54 is received into the slot 26 and the barbs 57 are received into the voids 47 (see also FIG. 16). Once the barbs 57 clear the body 44 (see also FIG. 16), the ribs 20 elastically return to their original, unflexed positions (see arrows G). The barbs 57 extend into the voids 47 and prevent inadvertent vertical movement of the divider 50 and decoupling of the divider 50 from the base 11. For example, the barbs 57 lock the divider 50 to the base 11. Note also that the tab 54 vertically extends below the body 44.

To decouple the divider 50 from the base 11, the technician pulls the divider 50 away from the base 11 (see arrow H on FIG. 14) with enough force such that the barbs 57 act one and elastically deform the body 44 and/or the ribs 20 thereby enlarging the slot 26. The barbs 57 then slide through the now enlarged slot 26 past the body 44 and slide through the channel 21 past the ribs 20.

In certain examples, a product display unit is for displaying products and includes a base longitudinally extending between a first base end and an opposite second base end and transversely extending between a first base side and an opposite second base side. The base has a planar body extending between the base ends and the base sides. A first rib and a second rib each extend from the body in a first vertical direction and define a longitudinally extending channel therebetween. A slot vertically extends through the body and is vertically aligned with the channel. A pair of projections extend from the body in a second vertical direction opposite the first vertical direction and define a void therebetween. The projections and the void are planar with the first rib. A divider has a bottom side and a tab extending in the second vertical direction from the bottom side. The tab has a transversely extending barb. The divider is coupled to the base by moving the divider in the second vertical direction such that the tab is received into the slot and the barb is received into the void.

In certain examples, the divider is decoupled from the base by moving the divider in the first vertical direction such that the barb deforms the body and the tab is slid in the first vertical direction out of the slot. In certain examples, the barb has a first barb end and a second barb end, and wherein width of the barb tapers from the first barb end toward the second barb end. In certain examples, the barb is a first barb and the void is a first void and the body has a second void in which a second barb of the tab is received when the divider is coupled to the base. The first barb and the second barb extend in opposite transverse directions.

In certain examples, the projections in the pair of projections are longitudinally spaced apart from each other. In certain examples, the projections are configured to rest on a shelf on which the product display unit is placed. In certain examples, the barb is a first barb and wherein the void is a first void and the body includes a third projection and a fourth projection that each extend from the body in the second vertical direction and are transversely spaced apart from the first projection and the second projection. The third projection and the fourth projection are longitudinally spaced apart from each other to thereby at least partially define a second void therebetween in which a second barb of the tab is received. In certain examples, the third projection and the fourth projection are in vertical alignment with the second rib. In certain examples, the divider includes a transversely extending lip that seats on the first rib. In certain examples, the divider includes a first lip that extends in a first transverse direction and a second lip that extends in a second transverse direction. The first lip seats on the first rib and the second lip seats on the second rib.

In certain examples, the divider includes a plurality of lips that each transversely extend from the divider and seat on the first rib. The lips in the plurality of lips are longitudinally spaced apart from each other. In certain examples, the plurality of lips are a first plurality of lips on a first side of the divider. The divider includes a second plurality of lips that each transversely extend from a second side of the divider and seat on the second rib, and wherein the lips in the second plurality of lips are longitudinally spaced apart from each other. In certain examples, the divider includes a lip that transversely extends from the divider and seats on the first rib, and the lip continuously extends longitudinally between a first divider end and a second divider end of the divider.

In certain examples, a product display unit for displaying products includes a base longitudinally extending between a first base end and an opposite second base end and transversely extending between a first side and a second side. The base has a slot longitudinally spaced between the first base end and the second base end. A divider has a first divider end, a second divider end, a plurality of legs with each leg of the plurality of legs longitudinally spaced apart from each other between the first divider end and the second divider end, and a tab. The divider is removably coupled to the base in either: a first orientation such that the tab is in the slot and the legs of the plurality of legs are in first positions relative to the base; or a second orientation such that the tab is in the slot and the legs of the plurality of legs are in second positions relative to the base. The second positions of the legs are longitudinally offset relative to the first positions of the legs.

In certain examples, in the first orientation, the first divider end is adjacent to the first base end and the second divider end is adjacent to the second base end; and in the second orientation, the first divider end is adjacent to the second base end and the second divider end is adjacent to the second base end. In certain examples, the slot longitudinally extends between the first base end and the second base end. In certain examples, the slot is one of a plurality of slots that are each aligned along a transversely extending axis that extends parallel to the first base end and the second base end. In certain examples, the divider is a first divider and the slot is a first slot. A second slot that is spaced apart from the first slot, and the first slot and the second slot are aligned along a transversely extending axis of the base. A second divider having a first divider end, a second divider end, a plurality of legs with each leg of the plurality of legs spaced apart from each other longitudinally between the first divider end and the second divider end, and a tab. The second divider is removably coupled to the base in either a first orientation such that the tab is in the second slot and the legs of the plurality of legs are in first positions relative to the base; or a second orientation such that the tab is in the second slot and the legs of the plurality of legs are in second positions relative to the base. The second positions of the legs being longitudinally offset from the first positions of the legs. The orientation of the second divider is opposite the orientation of the first divider. For example, the first divider is in the first orientation and the second divider is in the second orientation.

In certain examples, the product display unit for displaying products includes a base longitudinally extending between a first base end and an opposite second base end and transversely extending between a first base side and a second base side. The base has a slot longitudinally spaced between the first base end and the second base end. A divider has a first divider end, a second divider end, and a tab. The divider is removably coupled to the base in either: a first orientation such that the tab is in the slot and the first divider end is adjacent to the first base end and the second divider end is adjacent to the second base end; or a second orientation such that the tab is in the slot and the first divider end is adjacent to the second base end and the second divider end is adjacent to the first base end. In certain examples, the tab is aligned along a vertically extending axis of the divider, and when the divider is decoupled from the base the divider is rotated about the axis such that the divider can be coupled to the base in the first orientation or the second orientation.

In certain examples, the tab is the only tab extending from the bottom side of the divider that can couple the divider to the base as described above. In certain examples, the divider is devoid of more than one tab that can couple the divider to the base as described above. In certain examples, a first rib and a second rib each extend from the body in a first vertical direction and define a longitudinally extending channel therebetween such that the slot is planar and vertically aligned with the channel. In certain examples, the slot is the only slot between the first rib and the second rib that is capable of receiving the tab. In certain examples, a divider has only one tab and a base with only one slot between adjacent ribs that is capable of receiving the tab to minimize or eliminate the risk that the technician will incorrectly couple the divider to the base. For instance, if there were more than one slot between two adjacent ribs capable of receiving the tab, the technician may inadvertently insert the tab into the incorrect slot. In certain examples, the bottom side of the divider is received and nests between ribs such that the ribs to prevent transverse movement of the divider. In certain examples, the vertical surfaces of the projections that engage the tab prevent transverse movement of the divider.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A product display unit for displaying products, the product display unit comprising:

a base longitudinally extending between a first base end and an opposite second base end and transversely extending between a first base side and an opposite second base side, the base having:

a planar body extending between the base ends and the base sides;

a first rib and a second rib each extending from the body in a first vertical direction and defining a longitudinally extending channel therebetween;

a slot vertically extending through the body and being vertically aligned with the channel;

a pair of projections extending from the body in a second vertical direction opposite the first vertical direction and defining a void therebetween, wherein the projections, the void, and the first rib are coplanar in a vertically extending plane that is perpendicular to a longitudinal direction of the body; and a divider having a bottom side and a tab extending in the second vertical direction from the bottom side, the tab having a transversely extending barb; and wherein the divider is coupled to the base by moving the divider in the second vertical direction such that the tab is received into the slot and the barb is received into the void.

2. The product display unit according to claim 1, wherein the divider is decoupled from the base by moving the divider in the first vertical direction such that the barb deforms the body and the tab is slid in the first vertical direction out of the slot.

3. The product display unit according to claim 1, wherein the barb has a first barb end and a second barb end, and wherein a width of the barb tapers from the first barb end toward the second barb end.

4. The product display unit according to claim 1, wherein the barb is a first barb and the void is a first void;

wherein the body has a second void in which a second barb of the tab is received when the divider is coupled to the base; and wherein the first barb and the second barb extend in opposite transverse directions.

5. The product display unit according to claim 1, wherein the projections in the pair of projections are longitudinally spaced apart from each other.

6. The product display unit according to claim 5, wherein the projections are configured to rest on a shelf on which the product display unit is placed.

7. The product display unit according to claim 1, wherein the barb is a first barb and wherein the void is a first void;

wherein the body includes a third projection and a fourth projection that each extend from the body in the second vertical direction and are transversely spaced apart from a first projection and a second projection of the pair of projections; and wherein the third projection and the fourth projection are longitudinally spaced apart from each other to thereby at least partially define a second void therebetween in which a second barb of the tab is received.

8. The product display unit according to claim 7, wherein the third projection and the fourth projection are in vertical alignment with the second rib.

9. The product display unit according to claim 1, wherein the divider includes a transversely extending lip that seats on the first rib.

10. The product display unit according to claim 1, wherein the divider includes a first lip that extends in a first transverse direction and a second lip that extends in a second transverse direction, and wherein the first lip seats on the first rib and the second lip seats on the second rib.

11. The product display unit according to claim 1, wherein the divider includes a plurality of lips that each transversely extend from the divider and seat on the first rib, and wherein the lips in the plurality of lips are longitudinally spaced apart from each other.

12. The product display unit according to claim 11, wherein the plurality of lips are a first plurality of lips on a first face of the divider; and wherein the divider includes a second plurality of lips that each transversely extend from a second face of the divider and seat on the second rib, and wherein the lips in the second plurality of lips are longitudinally spaced apart from each other.

13. The product display unit according to claim 1, wherein the divider includes a lip that transversely extends from the divider and seats on the first rib, and wherein the lip continuously extends longitudinally from a first divider end and a second divider end of the divider.

* * * * *